US010576762B2

(12) United States Patent
Shibata

(10) Patent No.: US 10,576,762 B2
(45) Date of Patent: Mar. 3, 2020

(54) RECORDING MEDIUM TRANSPORT DEVICE AND RECORDING DEVICE

(71) Applicant: Seiko Epson Corporation, Tokyo (JP)

(72) Inventor: Yohei Shibata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/068,605

(22) PCT Filed: Nov. 14, 2016

(86) PCT No.: PCT/JP2016/083691

§ 371 (c)(1),
(2) Date: Jul. 6, 2018

(87) PCT Pub. No.: WO2017/119193

PCT Pub. Date: Jul. 13, 2017

(65) Prior Publication Data

US 2019/0016162 A1 Jan. 17, 2019

(30) Foreign Application Priority Data

Jan. 8, 2016 (JP) ..... 2016-002307

(51) Int. Cl.
*B41J 13/02* (2006.01)
*B41J 15/16* (2006.01)
(Continued)

(52) U.S. Cl.
CPC ..... *B41J 13/02* (2013.01); *B41J 15/16* (2013.01); *B65H 5/06* (2013.01); *B65H 19/10* (2013.01);
(Continued)

(58) Field of Classification Search
CPC ..... B41K 11/04; B41K 11/007; B41K 11/004; B41J 13/02; B41J 13/08; B41J 13/103;
(Continued)

(56) References Cited

U.S. PATENT DOCUMENTS

2007/0284810 A1* 12/2007 Nakazawa et al. ..... 271/228
2013/0271542 A1* 10/2013 Leighton ..... 347/104
2016/0023858 A1* 1/2016 Mizuno ..... B65H 9/002

FOREIGN PATENT DOCUMENTS

JP 05-066980 A 3/1993
JP 2001-341897 A 12/2001
(Continued)

OTHER PUBLICATIONS

International Search Report cited in PCT/JP2016/083691 dated Feb. 7, 2017. (1 page).

*Primary Examiner* — Juanita D Jackson

(74) *Attorney, Agent, or Firm* — Workman Nydegger

(57) ABSTRACT

A recording device capable of preventing an occurrence of a transport wrinkle in a transport path is provided. A recording medium transport device includes a driving roller (111) and a driven roller (112) arranged such that a roller axial direction of the driving roller and a roller axial direction of the driven roller are parallel to each other, a recording medium (1) being transported by driving the driving roller (111) with the recording medium (1) held between the driving roller (111) and the driven roller (112), and the driven roller (112) is movably supported from a predetermined position in the roller axial direction, and in a case where the driven roller (112) is separated from the driving roller (111) without holding the recording medium (1) between the driven roller and the driving roller (111), the driven roller (112) moves to the predetermined position in the roller axial direction.

4 Claims, 5 Drawing Sheets

(51) Int. Cl.

| | |
|---|---|
| ***B65H 20/02*** | (2006.01) |
| ***B65H 5/06*** | (2006.01) |
| ***B65H 19/10*** | (2006.01) |
| ***B65H 19/22*** | (2006.01) |
| ***B65H 23/038*** | (2006.01) |

(52) U.S. Cl.
CPC ..... *B65H 19/22* (2013.01); *B65H 20/02* (2013.01); *B65H 23/038* (2013.01); *B65H 2404/1321* (2013.01); *B65H 2404/143* (2013.01); *B65H 2404/1424* (2013.01); *B65H 2404/1523* (2013.01); *B65H 2515/842* (2013.01); *B65H 2801/36* (2013.01)

(58) Field of Classification Search
CPC . B41J 15/16; B65H 5/06; B65H 19/10; B65H 19/22; B65H 9/002; B65H 9/006; B65H 9/103; B65H 9/16
See application file for complete search history.

(56) References Cited

FOREIGN PATENT DOCUMENTS

| | | | |
|---|---|---|---|
| JP | 2003-025664 | A | 1/2003 |
| JP | 2005-001293 | A | 1/2005 |
| JP | 2010-168220 | A | 8/2010 |
| JP | 2014-172745 | A | 9/2014 |

* cited by examiner

RECORDING MEDIUM TRANSPORT DEVICE AND RECORDING DEVICE

TECHNICAL FIELD

The present invention relates to a recording medium transport device and a recording device including the recording medium transport device.

BACKGROUND ART

An ink jet-type printer serving as a recording device alternately repeats an operation of discharging ink droplets from a recording head onto a recording medium transported on a platen, and an operation of moving the recording medium, and thus records an image on the recording medium.

PTL 1 discloses a recording device in which a nip roller constituted by a driving roller and a driven roller is arranged before and after an platen in the transport path of a recording medium, the recording medium is set to a predetermined recording position on the platen, and then an image is recorded in an intended area on the recording medium while the recording medium is moved by a predetermined amount (pitch feeding) by the nip roller.

CITATION LIST

Patent Literature

PTL 1: JP-A-2003-25664

SUMMARY OF INVENTION

Technical Problem

However, in the recording device disclosed in PTL 1, during the operation in which the image is being recorded in the intended area on the recording medium, a nip state of the recording medium is continuous before and after the platen. Thus, even when an alignment deviation occurs in the recording medium in the transport path, for example, such alignment deviation my not be eliminated during the recording operation of the image. In particular, in a case where the recording medium has a long band-like shape, and the length of the image to be recorded is long along the recording medium, the movement of the recording medium continues while the nip state is maintained until the recording of the image is complete. Hence, a slight alignment deviation of the recording medium accumulates into a large deviation through continuation of the recording, and such a deviation may cause wrinkles to occur in the recording medium.

Solution to Problem

The invention has been made to address at least a part of the issues described above, and can be achieved as the following application examples or aspects.

Application Example 1

A recording medium transport device according to the present application example includes a driving roller and a driven roller arranged such that a roller axial direction of the driving roller and a roller axial direction of the driven roller are parallel to each other, a recording medium being transported by driving the driving roller with the recording medium held between the driving roller and the driven roller. The driven roller is movably supported from a predetermined position in the roller axial direction, and in a case where the driven roller is separated from the driving roller without holding the recording medium between the driven roller and the driving roller, the driven roller moves to the predetermined position in the roller axial direction.

According to the present application example, since the driven roller is movably supported from the predetermined position in the roller axial direction, the recording medium is more easily moved in the roller axial direction, even when the recording medium is held by the driving roller and driven roller. Consequently, for example, even in a case where a force is exerted in the roller axial direction that is likely to cause wrinkling of the recording medium, the recording medium is capable of slowly moving in response to such a force in conjunction with the transportation. For example, an occurrence of positional deviations accumulating and causing wrinkles can be eliminated. In addition, when the driven roller is separated from the driving roller without holding the recording medium together between the driven roller and the driving roller, the driven roller moves to the predetermined position in the roller axial direction. Thus, in an initial state where the recording medium is held by the driving roller and the driven roller, the driven roller is capable of moving from the predetermined position. For example, setting the predetermined position to be the center of the movable range eliminates constraints on the movement direction.

Application Example 2

In the recording medium transport device according to the aforementioned application example, in a case where the driven roller moves from the predetermined position in the roller axial direction, the driven roller is biased in a direction returning to the predetermined position.

According to the present application example, when the driven roller moves from the predetermined position in the roller axial direction, the driven roller is biased in the direction returning to the predetermined position. Thus, when the driven roller is separated from the driving roller without holding the recording medium between the driven roller and the driving roller and becomes free, the driven roller moves to the predetermined position in the roller axial direction. Consequently, in the initial state where the recording medium is held by the driving roller and the driven roller, the driven roller is capable of moving from the predetermined position.

Application Example 3

In the recording medium transport device according to the aforementioned application example, the recording medium transport device includes a detector configured to detect that a movement amount of the driven roller from the predetermined position in the roller axial direction reaches a maximum allowable movement amount.

According to the present application example, it is possible to detect that the movement amount of the driven roller from the predetermined position reaches the maximum allowable movement amount. For example, in a case where the driven roller moves while eliminating alignment deviations of the recording medium, the movement amount reaches the maximum allowable movement amount, and the alignment deviations cannot be eliminated, suitable measures can be taken based on a detection result.

Application Example 4

In the recording medium transport device according to the aforementioned application example, the recording medium transport device includes a recording medium unwinding unit configured to store the recording medium in a roll state, and to unwind the recording medium; and a recording medium winding unit configured to wind the recording medium that has been unwound.

According to the present application example, the recording medium supplied in the roll state is transported while holding the recording medium between the driving roller and the driven roller, and in addition, the recording medium is wound. Furthermore, the driven roller is movably supported from the predetermined position in the roller axial direction. Hence, even in a case where the recording medium is continuously transported with held by the driving roller and the driven roller, slight alignment deviations of the recording medium will not accumulate, and the recording medium is continuously transported. Consequently, an occurrence of wrinkling of the recording medium is prevented.

Application Example 5

In the recording medium transport device according to the aforementioned application example, in a case where the maximum allowable movement amount is denoted as D, a length of a transport path of the recording medium from the recording medium unwinding unit to the recording medium winding unit is denoted as L1, and a length of a transport path of the recording medium from the recording medium unwinding part to a position where the recording medium is held between the driving roller and the driven roller is L2, $D \leq 10\ \text{mm} \times L2/L1$ is satisfied.

According to the present application example, in a case where the transport path of the recording medium from the recording medium unwinding unit to the recording medium winding unit is configured like a straight line when the transport path developed into a virtual plane is viewed, the winding positional deviation at the recording medium winding unit can be suppressed to 10 mm or below.

Application Example 6

The recording device according to the present application example includes the recording medium transport device according to the aforementioned application example, and a recording unit configured to perform recording on the recording medium.

According to the present application example, recording is performed while suppressing alignment deviations or wrinkling of the recording medium caused by such deviations.

DESCRIPTION OF EMBODIMENTS

Hereinafter, exemplary embodiments in which the invention is achieved will be described with reference to the accompanying drawings. The following description is one exemplary embodiment of the present invention, and does not limit the present invention. Note that, in each diagram below, elements may be illustrated on a scale that differs from actuality for ease of explanation. In addition, in the coordinates added to the drawings, Z-axis direction is the up-down direction, +Z direction is the up direction, Y-axis direction is the front-back direction, +Y direction is the front direction, X-axis direction is the left-right direction, +X direction is the left direction, and X-Y plane is a horizontal plane. In the description below, even in cases where expressions that are originally strictly understood, such as orthogonal, parallel, or uniform, are used, such expressions do not mean only strictly orthogonal, parallel, or uniform, but rather include a degree of error allowable with respect to device functionality, a degree of error that could occur during manufacturing of the device, and the like.

Exemplary Embodiment 1

<Recording Device>

Figure 1:
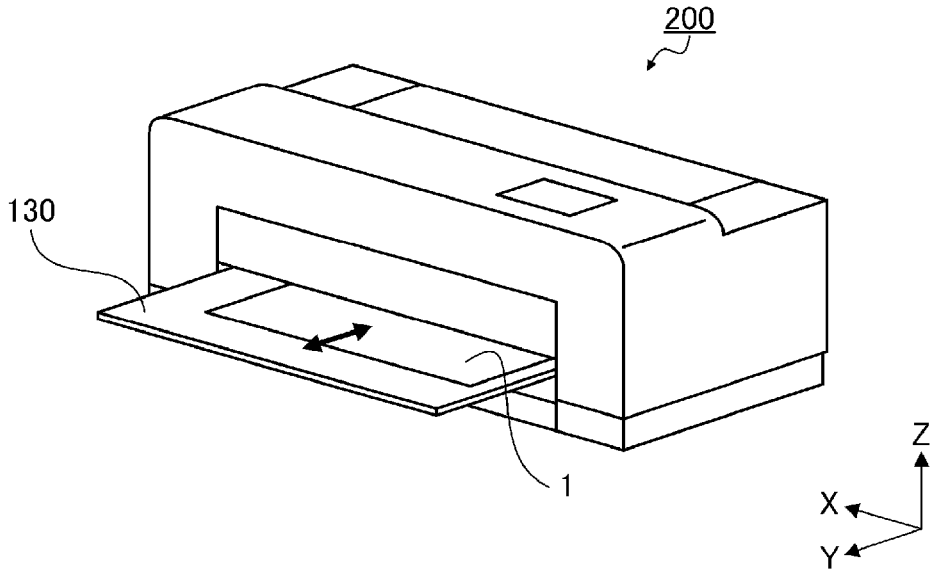
FIG. 1 is a perspective view illustrating a recording device including a recording medium transport device according to Exemplary Embodiment 1.
Figure 2:
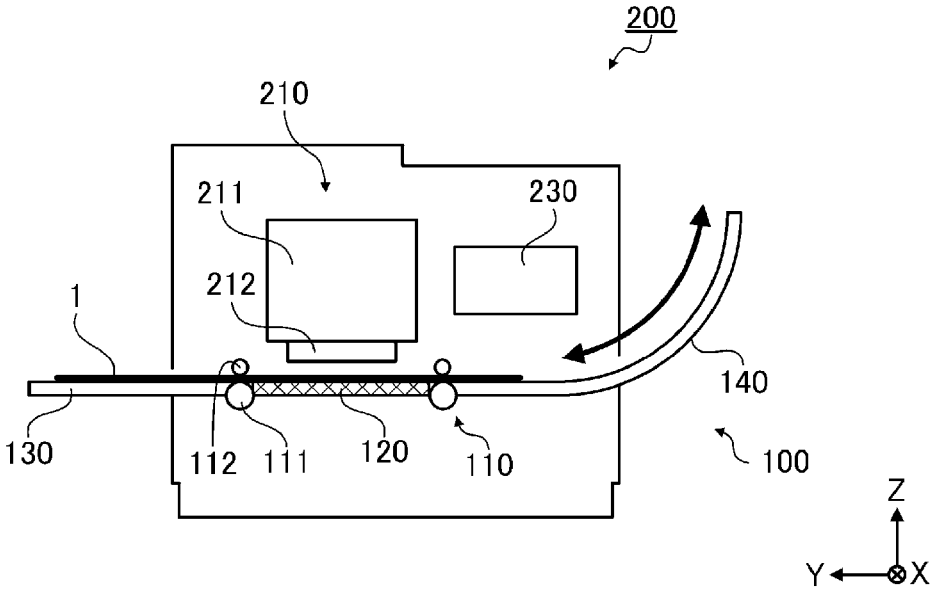
FIG. 2 is a conceptual view illustrating a configuration of a recording device including the recording medium transport device according to Exemplary Embodiment 1.

FIG. 1 is a perspective view illustrating a recording device 200 including a recording medium transport device according to Exemplary Embodiment 1. FIG. 2 is a conceptual view illustrating a configuration of the recording device 200.

The recording device 200 is an ink jet-type printer capable of recording (printing) on a recording medium 1 manually supplied from the front of the recording device 200, and includes a recording unit 210 that performs recording on the recording medium 1, a transport unit 100 serving as a "recording medium transport device" for transporting the recording medium 1 that has been set, a controller 230 that controls the entire recording device 200, and the like. The printing medium 1 manually supplied to the recording device 200 is a sheet of printing paper, for example.

The recording unit 210 includes a discharging head 212 that discharges ink droplets, a carriage 211 to which the discharging head 212 is attached and which moves over the surface of the recording medium 1 that has been supplied by the transport unit 100 in a scanning direction (X-axis direction intersecting a direction in which the transport unit 100 transports (moves) the recording medium 1), and the like.

The recording device 200, via control by the controller 230, alternately repeats a discharge operation of discharging ink droplets from the discharging head 212 while the carriage 211 is scanning and moving, and a transport operation of moving the recording medium 1 in a direction intersecting the scanning direction in a recording region, onto which ink droplets from the discharging head 212 are discharged, and thus forms (records) an image on the recording medium 1.

The transport unit 100 includes a plurality of transport rollers 110, a platen 120, a recording medium guiding guide 130, a back surface supporter 140, and the like. A transport path is constituted to enable the recording medium 1 to move back and forth from the recording medium guiding guide 130 through the recording region of the recording unit 210 to a recording standby region on the side opposite to the recording medium guiding guide 130 across the recording region.

The transport roller 110 includes a pair of a driving roller 111 and a driven roller 112 corresponding to the driving roller 111, and the like. When transporting the recording medium 1, the driven roller 112 exerts a biasing force to the paired driving roller 111 in a direction of pressing the recording medium 1 to nip the recording medium 1. Furthermore, for manually setting the recording medium 1, the driven roller 112 releases the nip at the recording medium guiding guide 130 until alignment is complete, so that the recording medium 1 is loosely inserted into the transport path.

The platen 120 is disposed in the recording region and supports the recording medium 1 in the recording region. The back surface supporter 140 is disposed in the recording standby region and supports the recording medium prior to recording.

A plurality (two groups in the example illustrated in FIG. 2) of the transport rollers 110 are driven and controlled by the controller 230. The transport rollers 110 transports the recording medium that has been set on the recording medium guiding guide 130 to the recording standby region of the back surface supporter 140. Then, the transport rollers 110 move the recording medium to the recording region on the platen 120 to move the recording medium 1 associated with a recording operation. The recording medium 1, on which the recording is complete, is passed from the recording region through the recording medium guiding guide 130 again via the transport roller 110 and discharged. The direction in which the recording medium 1 passes through the recording medium guiding guide 130 in conjunction with the discharge operation is called the discharge direction.

The controller 230, based on image data received from an external electronic device such as a personal computer or an external storage medium, controls the recording unit 210 and transport unit 100 as described above, and forms an image on the recording medium 1.

In such a configuration as described above, in a case where the recording medium 1 is set in the recording device 200 with insufficient alignment (positioning) of the recording medium 1 set from the recording medium guiding guide 130, or in a case where alignment deviation or the like inside the transport path occurs, transport wrinkles may occur on the recording medium 1 in the transport path. In contrast, in order to prevent an occurrence of such a situation, in the present exemplary embodiment, the recording medium transport device (transport unit 100) is configured as described below.

<Recording Medium Transport Device (Transfer Unit 100)>

The transfer unit 100 in the present exemplary embodiment includes the transport rollers 110, which are disposed before and after the platen 120 in the transport path of the recording medium 1, as illustrated in FIG. 2.

The transport rollers 110 each includes a driving roller 111 and a driven roller 112, which are arranged such that the roller axial directions are parallel to each other, and transport the recording medium 1 by driving the driving roller 111 with the recording medium 1 held between the driving roller 111 and the driven roller 112. Furthermore, the driven roller 112 is movably supported in the roller axial direction from a predetermined position. When the driven roller 112 is separated from the driving roller 111 without holding the recording medium 1 together with the driving roller 111, the driven roller 112 is biased to return to the predetermined position.

A detailed description will be given below.

Figure 3:
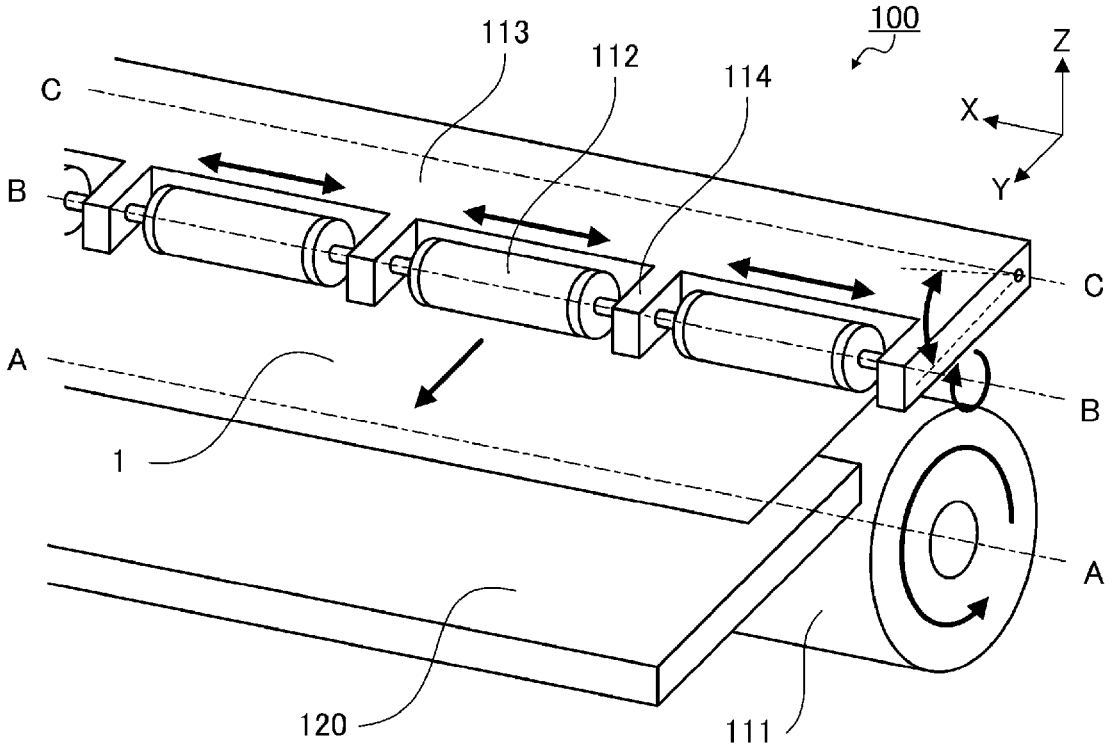
FIG. 3 is a perspective view illustrating a configuration of a part of a transport unit.

FIG. 3 is a perspective view illustrating a configuration of a part of the transport unit 100.

FIG. 3 illustrates the transport roller 110 on −Y side of the platen 120, but the same configuration also applies to the transport roller 110 on +Y side of the platen 120. The driving mechanism for rotating the transport roller 110 (driving roller 111) is not illustrated in the drawing.

The driving roller 111 extends across the width direction (X-axis direction) of the platen 120 at a length that covers the largest width of the recording medium 1 that is the target of the recording device 200. Furthermore, the driving roller 111 is provided below the platen 120 to be rotatable about the rotary shaft A-A such that the recording medium 1 is nipped together between the driving roller 111 and the driven roller 112 at a height on the transport surface, for the recording medium 1, of the platen 120.

A plurality of driven rollers 112 are provided in series above the platen 120 across the width direction of the driving roller 111 opposing the driven rollers 112, and the rotary shaft B-B of the driven rollers is supported by a support member 113.

The support member 113 includes an arm part 114 that supports the rotary shaft B-B of the driven rollers 112, and a rotary shaft C-C around which the support member 113 turns on the opposite side of the arm part 114 (−Y side in the example in FIG. 3).

The support member 113 turns around the rotary shaft C-C, and thus enables the plurality of driven rollers 112 to be pressed against the driving rollers 111 or to separate the plurality of driven rollers 112 from the driving rollers 111. The driving mechanism for rotating the support member 113 is not illustrated in the drawing.

In addition, the rotary shaft A-A, the rotary shaft B-B, and the rotary shaft C-C are each provided parallel to X-axis direction.

Figure 4:
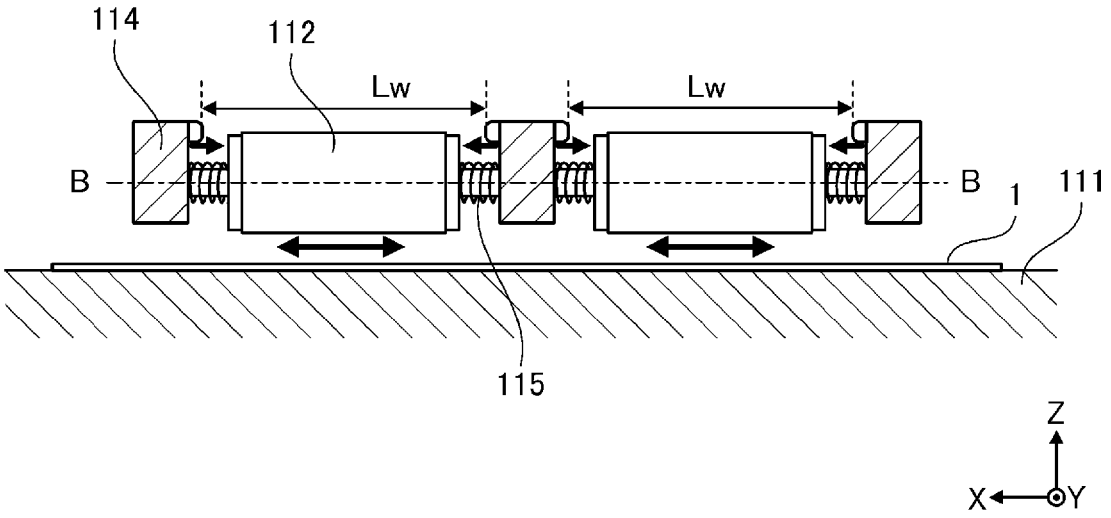
FIG. 4 is a front view of a driven roller supported by an arm part, as viewed from +Y side.

FIG. 4 is a front view of the driven roller 112 supported by an arm part 114, as viewed from +Y side.

The driven roller 112 is movably supported in a range of a width Lw in the roller axial direction (the direction of the rotary shaft B-B) between the arm parts 114 to be supported. Spring members 115 are provided on both sides of the driven roller 112, such that the rotary shaft of the driven roller 112 are loosely inserted into a spring member 115 between the driven roller 112 and the arm part 114. The spring member 115 presses the driven roller 112 toward the center position between the arm parts 114 on both sides of the driven roller 112 at an intensity that does not interrupt the movement of the driven roller 112. In other words, when the driven roller 112 is separated from the driving roller 111 without holding the recording medium 1 between the driven roller 112 and the driving roller 111 (when the driven roller 112 is in a free state), the driven roller 112 is biased by the elastic force of the spring member 115 to return to the center position, as "a predetermined position", between the arm parts 114 on both sides of the driven roller 112.

Figure 5:
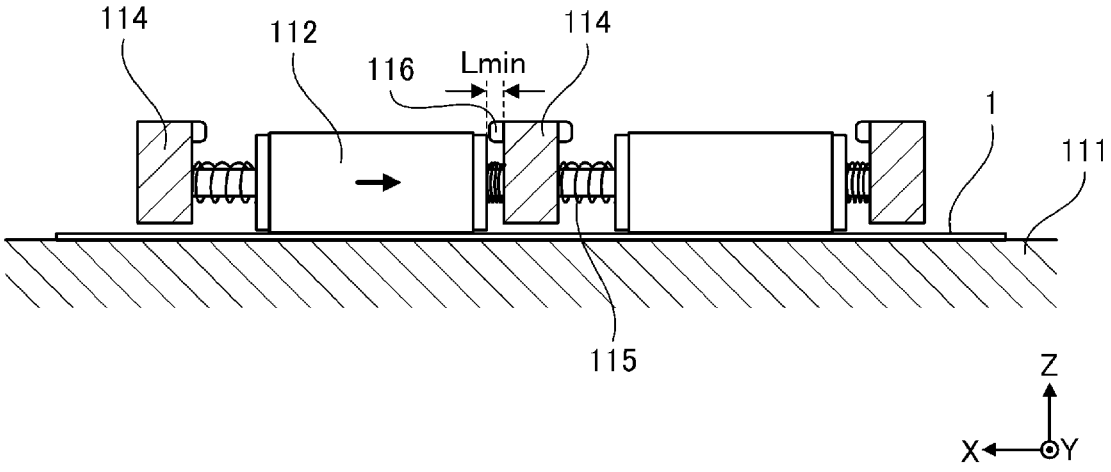
FIG. 5 is a front view of a recording medium held between the driven roller and a driving roller, as viewed from +Y side.

FIG. 5 is a front view of the driven roller 112, which is pressed by the driving roller 111 while being supported by the arm part 114, and which holds (nips) the recording medium 1 between the driven roller 112 and the driving roller 111, as viewed from +Y side.

The driven roller 112 is not only driven and rotated by the rotation of the drive roller 111, but rather is capable of moving in the roller axial direction (the direction of the rotary shaft B-B) due to the stress in the roller axial direction (in the direction of the rotary shaft B-B) received from the recording medium 1 held between the driving roller 111 and the driven roller 112. The movable range of the driven roller 112 is narrower than a gap width between the arm parts 114 (the range of the width Lw illustrated in FIG. 4). Thus, when the driven roller 112 receives a stress that necessitates a movement exceeding such a range from the recording medium 1, the driven roller 112 will lose a functionality following such a stress.

Therefore, the transport roller 110 includes a detector 116 for detecting that a movement amount from the predetermined position (the center position between the arm parts 114 on both sides of the driven roller 112) of the driven roller in the roller axial direction (the direction of the rotary shaft B-B) reaches the maximum allowable movement amount.

The detector 116, for example, detects that a distance between one end in the roller axial direction (the direction of the rotary shaft B-B) of the driven roller 112 and a side wall of the arm part 114 opposing such one end of the driven roller 112 reaches Lmin, which corresponds to a position where the movement amount of the driven roller 112 reaches the maximum allowable movement amount. This detection may be done by an electrically detecting circuit or an optically detecting circuit. The electrically detecting circuit can be, for example, a circuit that detects an electrical contact when Lmin is reached, or that detects a change in the distance between electrodes through a change in electrostatic capacitance. The optically detecting circuit can be, for example, a circuit that includes an irradiation unit and a light reception unit, and that detects a light reception amount changeable depending on the irradiated light or blocking of the reflection of such light when Lmin is reached.

The biasing force of the spring member 115 is desirably sufficiently weak relative to the stress received from the recording medium 1.

Furthermore, the biasing for returning the driven roller 112 to the predetermined position may be a configuration that uses a repelling magnetic force instead of the elastic force from the spring member 115.

As described above, the recording medium transport device and the recording device according to the present exemplary embodiment, can provide the following advantages.

The driven roller 112 is movably supported from the predetermined position in the roller axial direction (the direction of the rotary shaft B-B). Thus, the recording medium 1 can more easily move in the roller axial direction, even when the recording medium 1 is held by the driving roller 111 and driven roller 112. As a result, for example, even in a case where a force is exerted in the roller axial direction that seems likely to cause wrinkling of the recording medium 1, the recording medium 1 can slowly move in response to such a force in conjunction with the transportation. This eliminates occurrences of wrinkles caused by accumulated positional deviations, for example. Furthermore, when the driven roller 112 is separated from the driving roller 111 without holding the recording medium 1 between the driven roller 112 and the driving roller 111, the driven roller 112 is biased to return to the predetermined position. Hence, in the initial state where the recording medium 1 is held by the driving roller 111 and the driven roller 112, the driven roller 112 can move from the predetermined position. For example, setting the predetermined position to be the center of the movable range eliminates constraints in the movement direction.

Moreover, the detector 116 for detecting that the movement amount from the predetermined position of the driven roller 112 in the roller axial direction reaches the maximum allowable movement amount is provided. Therefore, it is possible to detect that the movement amount from the predetermined position of the driven roller 112 reaches the maximum allowable movement amount. For example, in a case where the driven roller 112 moves while eliminating alignment deviations of the recording medium 1 but the movement amount reaches the maximum allowable movement amount and the alignment deviations cannot be eliminated, suitable measures can be taken based on the detection result.

In addition, the recording device 200 includes the transport unit 100 as the "recording medium transport device", and thus recording can be performed while suppressing alignment deviations or wrinkling of the recording medium 1 caused by such deviations.

In the present exemplary embodiment, as illustrated in FIG. 2, the case where the transport rollers 110 are provided before and after the platen 120 in the transport path of the recording medium 1 has been described, but the present invention is not limited to such a configuration. For example, the configuration may include one transport roller 110 (a pair of the driven roller 112 and the driving roller 111), three or more transport rollers, or the like.

Exemplary Embodiment 2

Next, a recording medium transport device according to Exemplary Embodiment 2 and a recording device 300 including this recording medium transport device will be described. Here, the components that are the same as those in the exemplary embodiment described above are referenced using like numbers, and duplicate descriptions are omitted.

Figure 6:
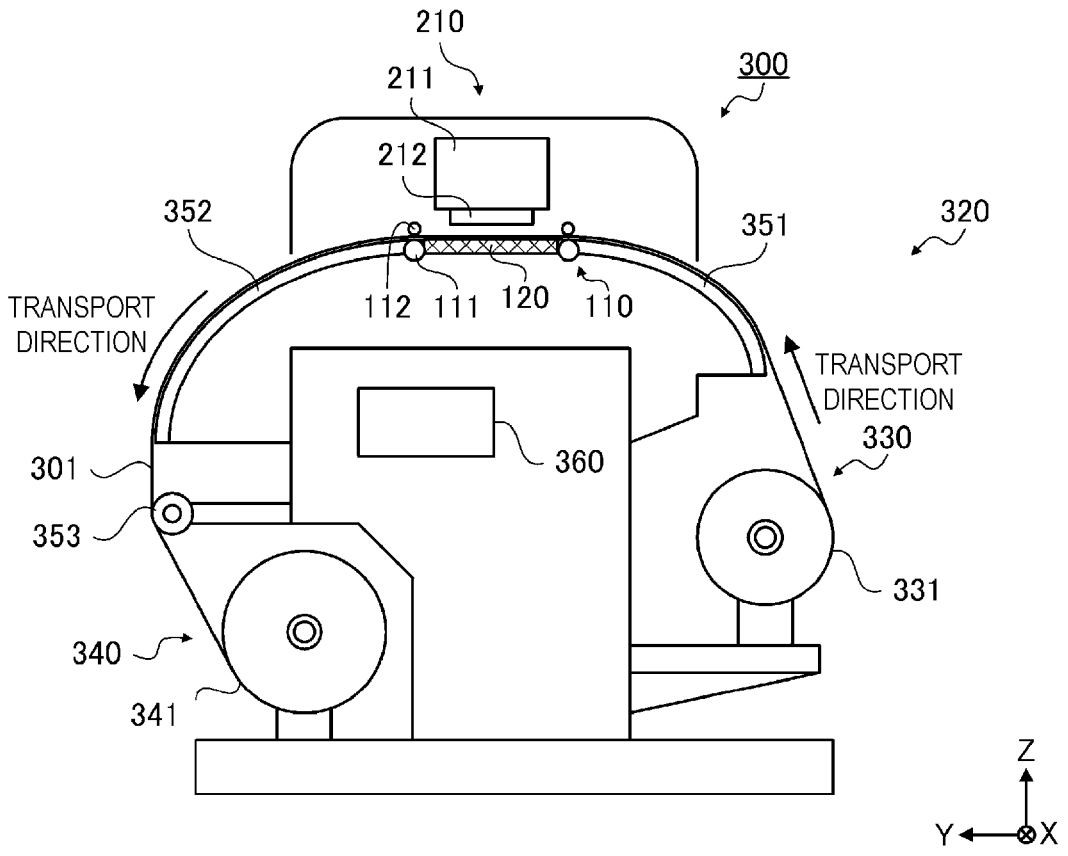
FIG. 6 is a conceptual view illustrating a configuration of a recording device including a recording medium transport device according to Exemplary Embodiment 2.

FIG. 6 is a conceptual view illustrating a configuration of the recording device 300 including the recording medium transport device according to Exemplary Embodiment 2.

The recording device 300 is an ink jet-type printer that records (prints) an image on a sheet of roll paper 301, which is the "recording medium" to be supplied in a state wound into a roll.

The roll paper 301 can be high quality paper, cast paper, art paper, coated paper, synthetic paper, or the like, for example. Furthermore, the recording medium is not limited to these types of paper, and can be a long film, fiber, or the like made of Polyethylene terephthalate (PET), polypropylene (PP), etc., for example.

The recording device 300 includes a recording unit 210, a transport unit 320 as the "recording medium transport device", a controller 360, and the like.

The recording unit 210, as described above, is configured with a serial head that reciprocates in the scanning direction (X-axis direction), but may be configured with a line head including nozzles for discharging ink arranged in alignment in the width direction of the roll paper 301, in a direction intersecting the transport direction. Moreover, a recording device may be used which includes a recording unit other than a so-called ink jet-type recording head as described above.

The transport unit 320 is a transport mechanism that moves the roll paper 301 in the transport direction and includes a plurality of transport rollers 110, a platen 120, transport paths 351 and 352, an unwinding unit 330 as a "recording medium unwinding unit", a winding unit 340 as a "recording medium winding unit", and the like. The roll paper 301 is supplied from the unwinding unit 330 and stored in the winding unit 340 in conjunction with the recording operation via the transport path 351, the recording unit 210 (platen 210), and the transport path 352.

Furthermore, the transport unit 320, in order to back-feed the roll paper 301, drives the driving roller 111 in reverse, and thus enables the roll paper 301 to move in a reverse transport direction that is the reverse of the transport direction. Back-feeding is performed in a case where overlap recording (printing) is further performed on the roll paper 301 which has already been recorded on, in a case where cueing (adjustment of recording start position) between recording (printing) jobs is performed, in a case where the roll paper 301 on which recording has been completed on the entire surface is rewound back onto the unwinding unit 330, or the like.

The unwinding unit 330 is a storage part where the roll paper 301 is stored prior to recording, is positioned on the upstream side of the recording unit 210 and the transport path 351 in the transport path, and includes an unwinding reel 331 and the like.

The unwinding reel 331 is rotated by an unwinding motor (not illustrated), which is driven and controlled by a controller 360, and unwinds the roll paper 301 toward the transport path 351 and the recording unit 210 arranged on the downstream side of the unwinding unit 330.

Furthermore, by driving the unwinding reel 331 in reverse, the unwinding unit 330 is capable of winding the roll paper 301 that is back-fed.

The winding unit 340 is a storage part where the roll paper 301 is wound after the recording is performed and is wound into a roll shape. The winding unit 340 is positioned on the downstream side of the recording unit 210 and the transport path 352 in the transport path, and includes a winding reel 341 and the like.

The winding reel 341 has a rotary shaft that rotates due to a winding motor (not illustrated) drivenly controlled by the controller 360, and winds the roll paper 301, which has been fed through the recording unit 210 and the transport path 352 with the rotary shaft as the shaft center.

Furthermore, by driving the winding reel 341 in reverse, the winding unit 340 is capable of unwinding the roll paper 301 that is back-fed.

The transport path configured with the transport unit 320 is a path where the roll paper 301 is transported from the unwinding unit 330 to the winding unit 340 through the recording unit 210 or is back-fed through the opposite path. The transport path is configured with the transport path 351, the platen 120 for supporting the roll paper 301 in the recording region of and recording unit 210, the transport path 352, a rotary bar member 353, and the like.

The rotary bar member 353 extends across the width direction of the roll paper 301 between the transport path 352 and the winding unit 340. The rotary shaft of the rotary bar member 353 is fixedly supported by the main body of the recording device 300. The rotary bar member 353 rotates in conjunction with the movement of the roll paper 301 abutting the rotary bar member 353 and supports the movement of the roll paper 301. The rotary bar member 353 may not necessarily include the rotary shaft, and may be a fixed bar member extending across the width direction of the roll paper 301 and supporting the roll paper 301.

The controller 360 controls the recording unit 210 and the transport unit 320, based on image data received from an external electronic device such as a personal computer or an external storage medium, as described above, and forms an image on the roll paper 301.

Figure 7:
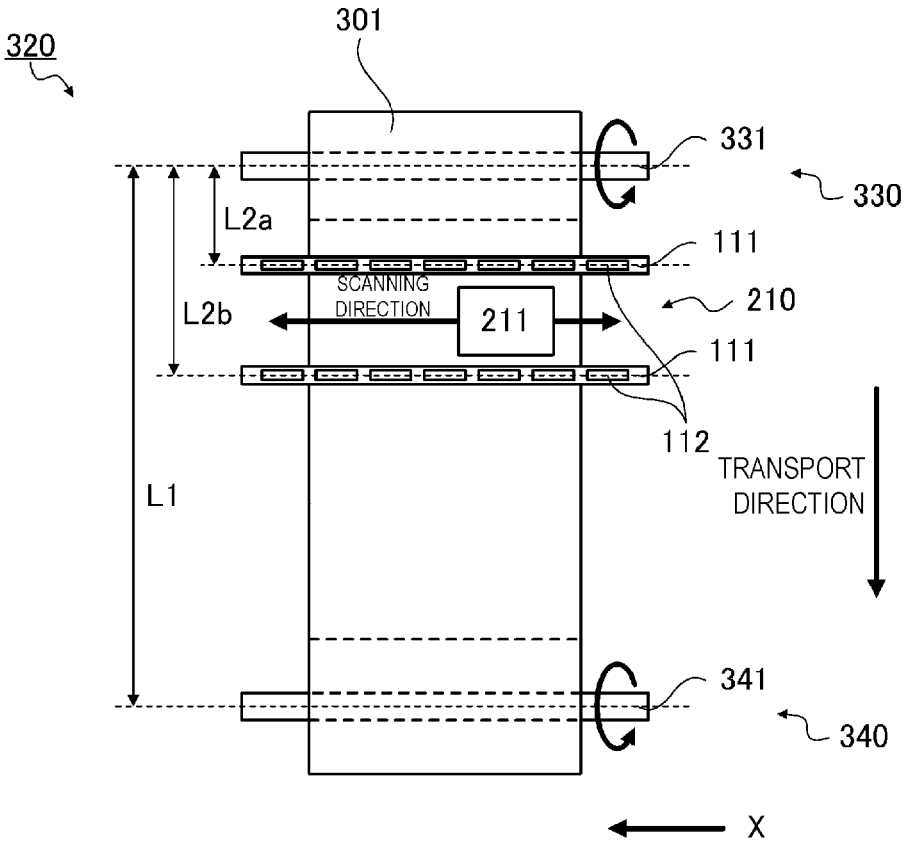
FIG. 7 is a schematic view in which a transport path from an unwinding unit to a winding unit, which are configured in the transport unit, is developed into a virtual plane.

FIG. 7 is a schematic view in which the transport path from the unwinding unit 330 to the winding unit 340, which are configured in the transport unit 320, is developed into a virtual plane.

In the present exemplary embodiment, the maximum allowable movement range, which is the maximum allowance of movement from the predetermined position for the driven roller 112 (the center position between the arm parts 414 on both sides of the driven roller 112 (refer to FIG. 4)) is specifically set as below.

Note that, in the present exemplary embodiment as well, as illustrated in FIG. 6, a description will be given of a case where the transport rollers 110 are provided before and after the platen 120 in the transport path of the roll paper 301.

In a case where the length of the transport path of the roll paper 301 from the unwinding unit 330 to the winding unit 340 is denoted as L1, and the length of the transport path of the roll paper 301 from the unwinding part 330 to the position where the roll paper 301 is held between the driving roller 111 and the driven roller 112 is L2*a* (the upstream side of the platen 120) and L2*b* (the downstream side of the platen 120), then the maximum allowable movement amount Da from the predetermined position of the driven roller 112 on the upstream side of the platen 120 and the maximum allowable movement amount Db from the predetermined position of the driven roller 112 on the downstream side of the platen 120 are values obtained by the expressions below.

$$Da \leq 10\ \text{mm} \times L2a/L1$$

$$Da \leq 10\ \text{mm} \times L2b/L1$$

In other words, the maximum allowable movement amount is set under the assumption that as the roll paper 301 moves farther away from the point of origin, which is set to the unwinding unit 330, in the transport path, the blurring amount caused by the alignment deviation is likely to be greater.

As described above, according to the recording medium transport device and the recording device in the present exemplary embodiment, the following advantages are achievable, in addition to the advantages of the exemplary embodiment described above.

The roll paper 301 supplied in the roll state is transported while being held by the roll paper between the driving roller 111 and the driven roller 112, and the roll paper is also wound. Furthermore, the driven roller 112 is movably supported from the predetermined position in the roller axial direction. Thus, even in a case where the roll paper 301 is continuously transported while being held by the driving roller 111 and the driven roller 112, slight alignment deviations of the roll paper 301 will not accumulate, and the roll paper 301 is continuously transported while eliminating such deviations. As a result, the occurrence of wrinkling of the roll paper 301 is prevented.

Furthermore, in a case where the transport path of the roll paper 301 from the unwinding unit 330 to the winding unit 340 is configured like a straight line when the transport path developed into a virtual plane is viewed, the winding positional deviation at the winding unit 340 can be suppressed to 10 mm or less.

In addition, by providing the recording device 300 in the transport unit 320 as the "recording medium transport device", recording is performed while suppressing alignment deviations or wrinkling of the roll paper 301 caused by such deviations.

Modified Example 1

In Exemplary Embodiment 1, the configuration has been adopted in which in order to return (move) the driven roller 112 to the predetermined position, the elastic force from the spring member 115 is used, and when the driven roller 112 moves from the predetermined position, a biasing force is exerted in the direction to return the driven roller 112 to the predetermined position. However, the present invention is not limited to this. For example, a configuration may be adopted in which biasing in the direction of the predetermined position is not performed when the recording medium 1 is nipped by the driving roller 111 and the driven roller 112, but the biasing is performed in the direction of the predetermined position when the driven roller 112 is free.

Specifically, for example, the biasing for returning the driven roller 112 to the predetermined position may be a configuration that uses a repelling electro-magnetic force instead of the elastic force from the spring member 115. A method may be used in which, via control by the controller 230, a biasing force is generated for returning the driven roller 112 to the predetermined position via an electromagnetic force only when the driven roller 112 is free.

Figure 8:
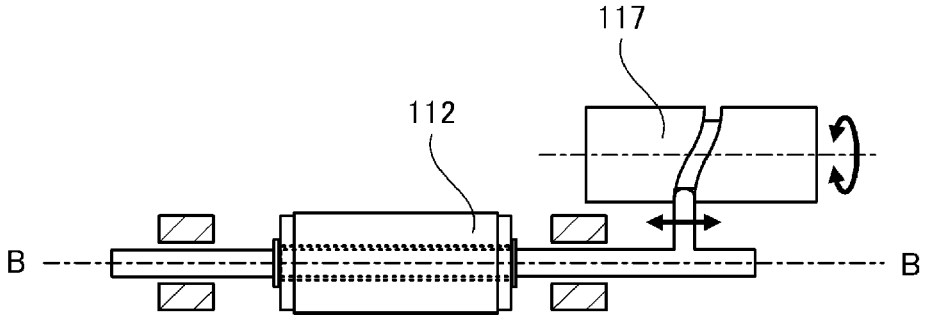
FIG. 8 is a conceptual view illustrating a modified example of a configuration in which the driven roller is moved to a predetermined position.

Furthermore, in order to return the driven roller 112 to the predetermined position, a driving force of a motor, air (compressed air), or the like may be used. For example, as illustrated in FIG. 8, a method may be used in which a cylindrical cam 117 that rotates by the driving force of a motor is used, and only when the driven roller 112 is free, the motor is driven by control of the controller 230 to return the driven roller 112 to the predetermined position.

REFERENCE SIGNS LIST

1 . . . Recording medium, 100 . . . Transport unit, 110 . . . Transport roller, 111 . . . Driving roller, 112 . . . Driven roller, 113 . . . Support member, 114 . . . Arm part, 115 . . . Spring member, 116 . . . Detector, 120 . . . Platen, 130 . . . Recording medium guiding guide, 140 . . . Back surface supporter, 200 . . . Recording device, 210 . . . Recording unit, 211 . . . Carriage, 212 . . . Discharging head, 230 . . . Controller, 300 . . . Recording device, 301 . . . Roll paper, 320 . . . Transport unit, 330 . . . Unwinding unit, 331 . . . Unwinding rail, 340 . . . Winding unit, 341 . . . Winding rail, 351,352 . . . Transport path, 360 . . . Controller

The invention claimed is:

1. A recording medium transport device, comprising:

a driving roller and a driven roller arranged such that a roller axial direction of the driving roller and a roller axial direction of the driven roller are parallel to each other, a recording medium being transported by driving the driving roller with the recording medium held between the driving roller and the driven roller, a recording medium unwinding unit configured to store the recording medium in a roll state, and to unwind the recording medium; and a recording medium winding unit configured to wind the recording medium that has been unwound, wherein:

the driven roller is movably supported from a predetermined position in the roller axial direction, in a case where the driven roller is separated from the driving roller without holding the recording medium between the driven roller and the driving roller, the driven roller moves to the predetermined position in the roller axial direction, in a case where a maximum allowable movement amount is denoted as D, a length of a transport path of the recording medium from the recording medium unwinding unit to the recording medium winding unit is denoted as L1, and a length of a transport path of the recording medium from the recording medium unwinding unit to a position where the recording medium is held between the driving roller and the driven roller is L2, and $D \leq 10\ \text{mm} \times L2/L1$ is satisfied.

2. The recording medium transport device according to claim 1, wherein in a case where the driven roller moves from the predetermined position in the roller axial direction, the driven roller is biased in a direction returning to the predetermined position.

3. The recording medium transport device according to claim 1, further comprising a detector configured to detect that a movement amount of the driven roller from the predetermined position in the roller axial direction reaches the maximum allowable movement amount.

4. A recording device, comprising:

the recording medium transport device according to claim 1; and a recording unit configured to perform recording on the recording medium.

* * * * *